US007481139B2

(12) United States Patent
Hsieh

(10) Patent No.: US 7,481,139 B2
(45) Date of Patent: Jan. 27, 2009

(54) TWISTING SPANNER WITH AUTO POSITIONING ASSEMBLY

(76) Inventor: Chih-Ching Hsieh, No. 367 Pei Yang Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 11/455,803

(22) Filed: Jun. 20, 2006

(65) Prior Publication Data

US 2007/0289421 A1 Dec. 20, 2007

(51) Int. Cl.
*B25B 23/159* (2006.01)

(52) U.S. Cl. ..... 81/478; 81/483; 73/862.23

(58) Field of Classification Search ..... 81/473–476, 81/478, 480–483; 73/862.23
See application file for complete search history.

(56) References Cited

U.S. PATENT DOCUMENTS 5,816,211 A * 10/1998 Atmur et al. ..... 123/193.4

5,911,801 A * 6/1999 Fravalo et al. ..... 81/478

* cited by examiner

*Primary Examiner*—D. S Meislin
(74) *Attorney, Agent, or Firm*—Ming Chow; Sinorica, LLC

(57) ABSTRACT

A twisting spanner with an auto positioning assembly comprises a push post; a hollow cylinder; and a periphery of the supporting seat having a cover; and a spring; one end of the spring having a supporting seat; and at least one end of the supporting seat having a positioning body. The positioning body is integrally formed with the supporting seat. The positioning body is a ball. The supporting seat has a positioning hole facing to the positioning groove. The cover is made of soft material. The cover is made of copper. The supporting seat has a limiting post capable of being inserted in to the spring. The supporting seat has a receiving hole receiving with at least one roller.

3 Claims, 5 Drawing Sheets

TWISTING SPANNER WITH AUTO POSITIONING ASSEMBLY

FIELD OF THE INVENTION

The present invention relates to spanners, and in particular to a twisting spanner with an auto positioning assembly which can reduce the structure destroy of the wall of the cover and the supporting seat thereof will be smooth and stable.

BACKGROUND OF THE INVENTION

Referring to FIGS. 7 and 8, the prior art twisting spanner is illustrated. In operation, the handle 30 must be twisted and the step of twisting setting value is set according to a scale 31 and a spring 33 between a push post 32 and a supporting seat 20 is compressed. After setting, the handle 30 is fixed. In operation, a pin 44 at one end of a main arm 41 is twisted to press the roller 21 of the supporting seat 20. Likewise, the roller 21 provides a react force until the force from the spanner is over the twisting force. The roller 21 will release from the pin 44 and the main arm 41 returns rapidly. Thus an end 41 of the main arm 41 will knock the wall of the cover 42 so as to have a knocking sound to inform the user not to increase the applied force for preventing the spanner from destroy.

However since the prior art spring 33 is long, as shown in FIG. 8, to cause the wall of the supporting seat 20 is smooth and the spring 33 can be compressed easily, the inner diameter is greater, but as a result, the spring 33 will bent. As a result the twisting value is not accuracy and is not stable. Thereby the spring 33 will fatigue and not return to the original position. That is to say that the moving length of the push post 32 driving by the handle 30 is long so that the twisting force cannot be set accuracy. It has an error of about 4%. The longer the spring, the greater the error. Furthermore, in the prior art, the supporting seat 20 has a hard ball to contact the wall of the cover 42 so that the wall of the cover 42 will be destroyed.

Moreover one end of the supporting seat 20 has a ball 23 ejecting the wall of the buffer cove 42 so that the supporting seat 20 will tilt so that the supporting seat 20 will be buckled. As a result the twisting value is not accurate.

SUMMARY OF THE INVENTION

Accordingly, the primary object of the present invention is to provide a twisting spanner with an auto positioning assembly which can reduce the structure destroy of the wall of the cover and the supporting seat thereof will be smooth and stable.

To achieve above objects, the present invention provides a twisting spanner with an auto positioning assembly which comprises a push post; a hollow cylinder; and a periphery of the supporting seat having a cover; and a spring; one end of the spring having a supporting seat; and at least one end of the supporting seat having a positioning body. The positioning body is integrally formed with the supporting seat. The positioning body is a ball. The supporting seat has a positioning hole facing to the positioning groove. The cover is made of soft material. The cover is made of copper. The supporting seat has a limiting post capable of being inserted into the spring. The supporting seat has a receiving hole receiving with at least one roller.

The various objects and advantages of the present invention will be more readily understood from the following detailed description when read in conjunction with the appended drawing.

DETAILED DESCRIPTION OF THE INVENTION

Figure 1:
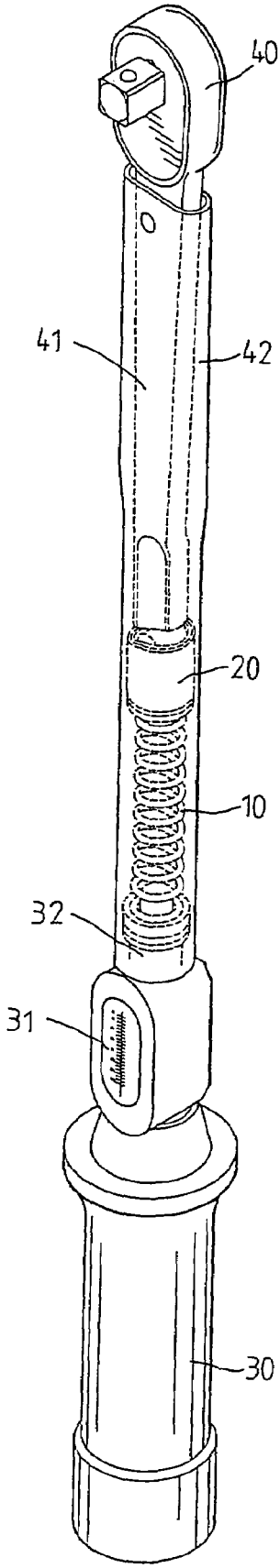
FIG. 1 is an assembled view of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIG. 1 to 4, the structure of the present invention is illustrated. The present invention has the following elements.

A spring (10) has two ends. One end of the spring (10) has a supporting seat 11. One end of the supporting seat 11 has a limiting post 12. The limiting post 12 can be inserted into the spring (10). Another end of the supporting seat 11 has a positioning body 13. The supporting seat 11 and the positioning body 13 can be formed integrally or separately.

A hollow cylinder 20 is installed at another end of the spring (10). A roller 21 is installed within the hollow cylinder 20 by using a shaft 211 to pass through the hollow cylinder 20 and the roller 21. The hollow cylinder 20 has two receiving holes 22 near the roller 21. Each receiving hole 22 is received with a ball 23. Thereby the roller 21 can roll easily.

A cover 24 sleeves the hollow cylinder 20. The hollow cylinder 20 is made of soft material, for example, copper. A lower side of the cover 24 has a positioning groove 241. A periphery of the cover 24 has a round shape. Thus, the hollow cylinder 20 can slide in the cover 24 smoothly without tilt.

Figure 2:
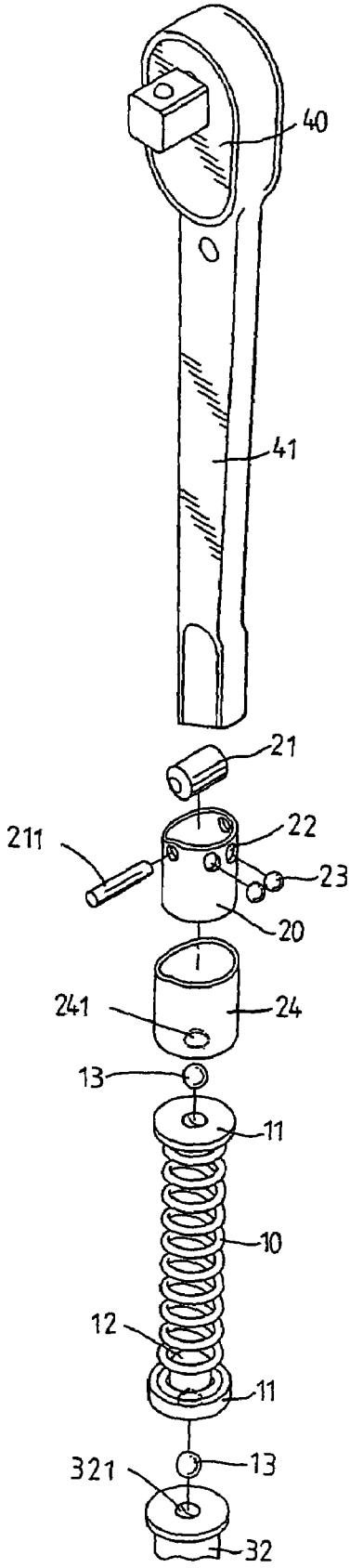
FIG. 2 is an exploded view of the present invention.

Referring to FIGS. 1 and 2, a pushing post 32 is located below the spring (10). A scale 31 is located below the pushing post 32 and an adjustable handle 30 is rotatably located below the scale 31. The setting of the twisting force applied from the spanner can be set with reference to the scale 31. An upper center of the pushing post 32 has a positioning hole 321 for receiving the positioning body 13.

Figure 3:
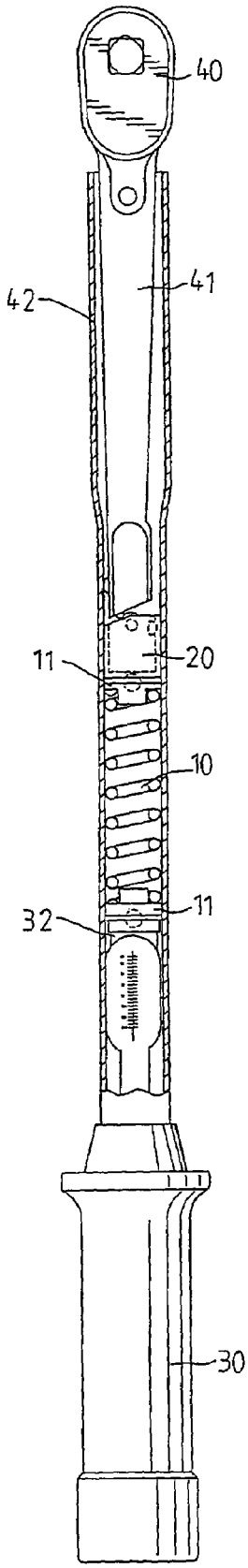
FIG. 3 is a cross sectional view of the present invention.
Figure 4:
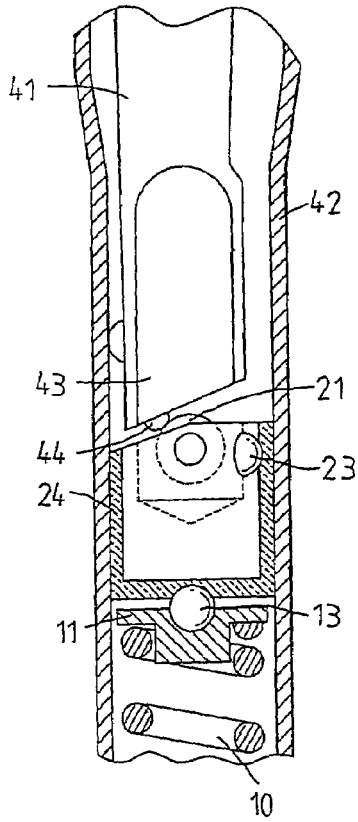
FIG. 4 is a partial enlarged view of the present invention.

Referring to FIGS. 3 and 4, a main arm 41 extends from a driving portion 40. A sleeve 42 sleeves the main arm 41, hollow cylinder 20, spring (10) and push post 32. One end portion 43 of the main arm 41 is extended with a pin 44.

Figure 5:
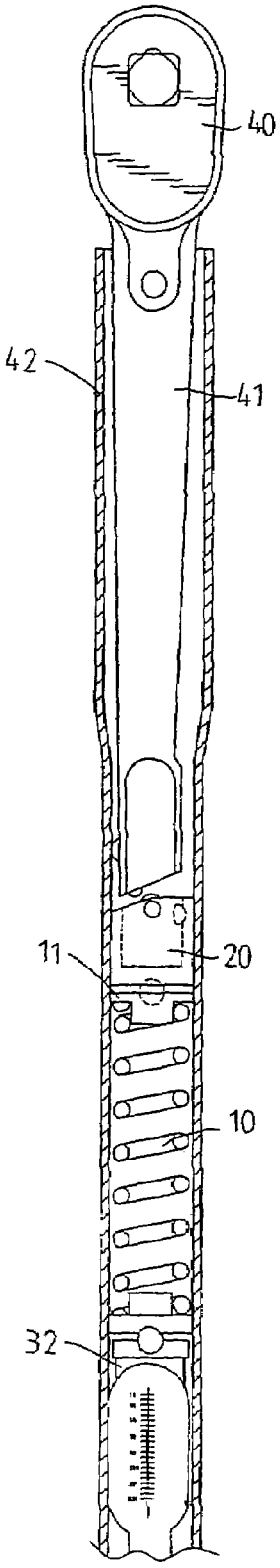
FIG. 5 is a schematic view about the spring of the present invention.
Figure 6:
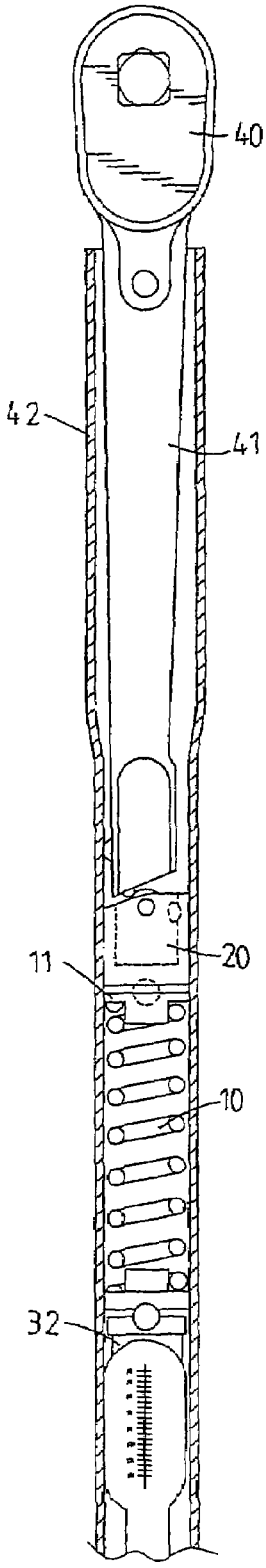
FIG. 6 is a schematic view showing that the spring is compressed according to the present invention.
Figure 7:
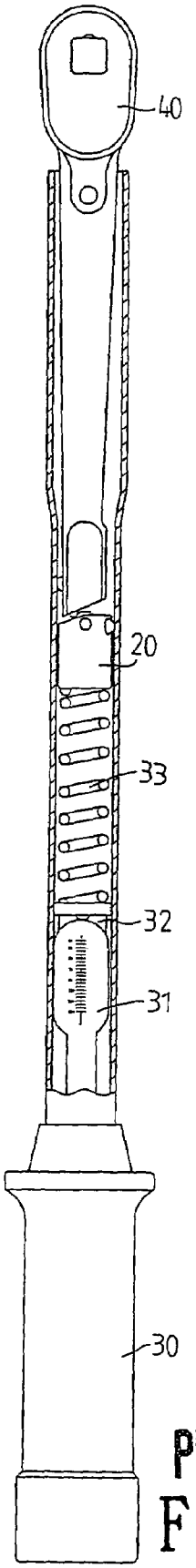
PRIOR ART FIG. 7
FIG. 7 is a cross sectional view of the prior art twisting spanner.
Figure 8:
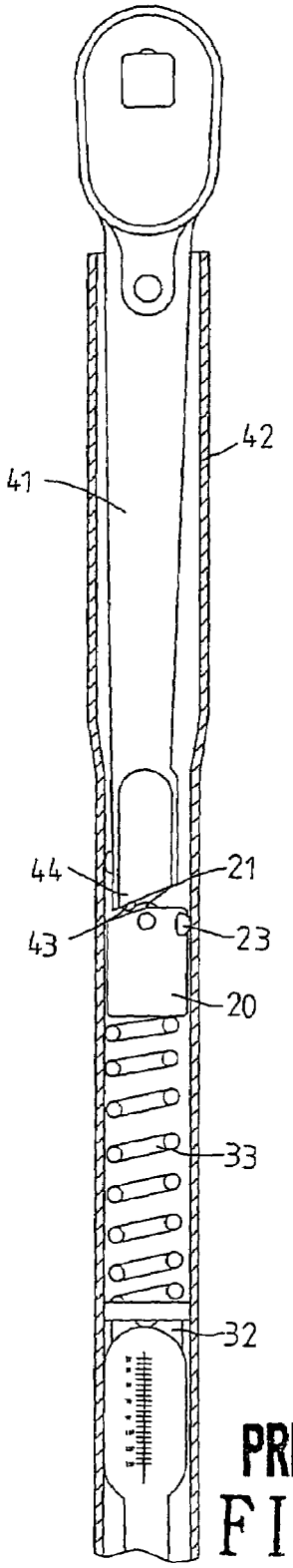
PRIOR ART FIG. 8
FIG. 8 is a schematic view showing that the spring is compressed according to the prior art.

Referring to FIGS. 5 and 6, in assembly, the supporting seat 11 is located in the positioning groove 241 of the cover 24 and the positioning body 13 is received in the positioning hole 321 of the push post 32 so that the spring (10) can be retained in a straight state. When the push post 32 of the adjustable handle 30 presses the spring (10), the spring (10) still retains straightly. Thus the length of the spring (10) can be well controlled so that the twisting force for separating the roller 21 and the pin 44 at the end of the main arm 41 can be well adjusted. Thus the middle section of the spring (10) will not bent. Thereby the spring (10) will not fatigue.

Moreover in the present invention, the positioning body 13 can be a ball so that the positioning body 13 is rollable in the positioning hole 321 of the push post 32. Thus the spring (10) can resilient rapidly so that the sensitivity about the setting of the twisting force is enhanced with higher precision and accuracy. The cover 24 has the effect of protecting the hollow cylinder 20.

Advantages of the present invention will be described herein. In the present invention, by the supporting seat and the positioning body, the spring can be steadily located in the cover so that the length of the spring can be well controlled with higher precision and accuracy. The positioning body can be a ball so that the spring can resilient rapidly so that the sensitivity about the setting of the twisting force is enhanced with higher precision and accuracy. Furthermore, the cover has the effect of protecting the hollow cylinder. Further the cover is made of copper which can dissipate heat effectively. As the cover is used for a long time, it can retained in a preferred smoothness.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A twisting spanner with an auto positioning assembly comprising:

a spring (10) having two ends; each end of the spring (10) having a supporting seat (11); one end of each supporting seat (11) having a limiting post (12); the limiting post (12) being inserted in the spring (10); another end of each supporting seat (11) having a positioning body (13);

a hollow cylinder installed at another end of the spring (10); a roller (21) being installed within the hollow cylinder (20) by using a shaft (211) to pass through the hollow cylinder (20) and the roller (21); the hollow cylinder (20) having two receiving holes (22) near the roller (21); each receiving hole (22) being received with a ball (23); thereby the roller (21) can roll easily;

a cover (24) enclosing the hollow cylinder (20); a lower side of the cover (24) having a positioning groove (241); a periphery of the cover (24) having a round shape; thus, the hollow cylinder (20) can slide in the cover (24) smoothly without tilting;

a pushing post (32) being located below the spring (10); a scale (31) being located below the pushing post (32) and an adjustable handle (30) being rotatably located below the scale (31); an upper center of the pushing post (32) having a positioning hole (321);

a main arm (41) extending from a driving portion (40); a sleeve (42) enclosing the main arm (41), the hollow cylinder (20), spring (10) and the push post (32); one end portion (43) of the main arm (41) being extended with a pin (44) for engagement with the roller (21); and wherein in assembly, one of the positioning bodies (13) is located in the positioning groove (241) of the cover (24) and the other of the positioning bodies (13) is received in the positioning hole (321) of the pushing post (32) so that the spring (10) is retained in a straight state; when the pushing post (32) of the adjustable handle (30) presses the spring (10), the spring (10) still retains straightly; and thus the length of the spring (10) can be well controlled so that the twisting force for separating the roller (21) and the pin (44) at the end of the main arm (41) can be well adjusted.

2. The twisting spanner with an auto positioning assembly as claimed in claim 1, wherein the hollow cylinder (20) is made of copper.

3. The twisting spanner with an auto positioning assembly as claimed in claim 1, wherein each positioning body (13) is a ball so that the positioning body 13 is rollable in the positioning hole 321 of the pushing post 32 and in the positioning groove (241) of the cover (24); and thus the spring (10) resilients rapidly.

* * * * *